United States Patent [19]

Wilson

[11] Patent Number: 4,712,595

[45] Date of Patent: Dec. 15, 1987

[54] MAGNETIC SAFETY FUNNEL

[76] Inventor: Harold L. Wilson, P.O. Box 394, Pevely, Mo. 63070

[21] Appl. No.: 897,131

[22] Filed: Aug. 15, 1986

[51] Int. Cl.[4] ..... B65B 3/06

[52] U.S. Cl. ..... 141/201; 141/DIG. 1

[58] Field of Search ..... 137/410, 416; 141/1, 141/95, 201, DIG. 1; 210/429

[56] References Cited

U.S. PATENT DOCUMENTS

| | | | |
|---|---|---|---|
| 493,994 | 3/1893 | Gaudron | 210/109 |
| 579,649 | 3/1897 | Luckenback | 141/202 |
| 883,289 | 3/1908 | Burg | 141/201 X |
| 994,272 | 6/1911 | Parker | 73/294 |
| 2,715,488 | 8/1955 | Conlon | 141/95 |
| 3,123,106 | 3/1964 | Parhaniemi | 141/204 |

FOREIGN PATENT DOCUMENTS

| | | | |
|---|---|---|---|
| 348251 | 12/1920 | Fed. Rep. of Germany | 141/201 |

*Primary Examiner*—Mark John Thronson

*Attorney, Agent, or Firm*—Glenn K. Robbins

[57] ABSTRACT

A safety funnel to prevent overfilling of a container being filled. The safety funnel comprises a funnel having a float supported in the funnel spout adapted to close a valve in the funnel spout when the container fill level is reached. A ring magnet is connected to the spout to attract a metallic member attached to the float and guide rod assembly into a valve seating engagement and maintain this relationship when the container is filled. The guide rod is guided within plate-like strainers and has an upper portion extending into the funnel above the spout which may be operated to open the valve to drain excess fluid in the funnel. The entire assemblage is constructed within the spout in protected relation.

5 Claims, 4 Drawing Figures

MAGNETIC SAFETY FUNNEL

BACKGROUND OF THE INVENTION

In the past the filling of a container that is opaque or where it has been difficult to see the fill level has presented problems in overfilling and spilling of the fluid. Where such fluid is toxic or flammable or expensive the damage is quite apparent.

While various funnels have been devised with different types of safety floats, there has continued to exist a need for a simply constructed funnel with means for preventing overfill of the container to be filled as well. There has further been a need in a safety funnel having means for preventing overfill of draining any excess fluid retained in the funnel without spilling.

SUMMARY OF THE INVENTION

By means of this invention there has been provided a safety funnel which can be used to prevent overfill of the container being filled. Further, after the container has been filled excess fluid in the funnel reservoir may be simply and easily drained through the spout by opening a valve without danger of spilling.

The funnel of this invention makes use of a float inside the spout and valve structure which does not obstruct the interior of the funnel body nor extend outside the spout. The float fits within the spout and provides for passage of fluid from the funnel reservoir through the spout to the container to be filled.

The float acts when it is immersed in the fluid in the container to be filled to prevent overflow by causing the seating of a valve inside the funnel spout to prevent further filling and overflow.

In order to provide fast and positive seating of the valve when the fill level in the container approaches the float a magnet system is employed inside the spout. A ring magnet is employed in the spout to attract a metallic element attached to a guide rod supporting the float and passing through the spout and into the interior of the funnel body. It will be understood that this arrangement may be reversed as desired. The magnet system not only facilitates the seating but maintains this arrangement when the funnel is removed with excess fluid in the funnel reservoir.

The safety valve that is closed when the container is filled is comprised of the fixed magnet as a valve seat and the metallic element which may be seated against it by the aforementioned magnetic attraction.

The float and metallic member are both supported on a vertically moveable guide rod which extends from inside the spout into the funnel body. The guide rod fits slidably through a pair of strainers adjacent to the top and bottom of the spout. The strainers serve a multi-fold function in acting as a guide for the guide rod, float and metallic member, as a strainer to prevent foreign objects from passing through the funnel and as a protective barrier to prevent damage to the internal moveable parts within the spout. The top portion of the guide may be manually operable after the valve is closed and magnetically retained in the closed position to open the valve and drain the contents while resetting the float.

The safety funnel may be employed as any conventional funnel with the features described. The funnel reservoir is substantially unobstructed while presenting the guide rod for ready operation. Standard materials of construction are employed to provide a rugged, inexpensive simply employed safety funnel.

The above features are objects of this invention. Further objects will appear in the detailed description which follows and will be further apparent to those skilled in the art.

For the purposes of illustration of this invention, preferred embodiments thereof are shown in the accompanying drawing. It is understood that the drawing is for purpose of description only and that the invention is not limited thereto.

IN THE DRAWING

DESCRIPTION OF THE INVENTION

Figure 1:
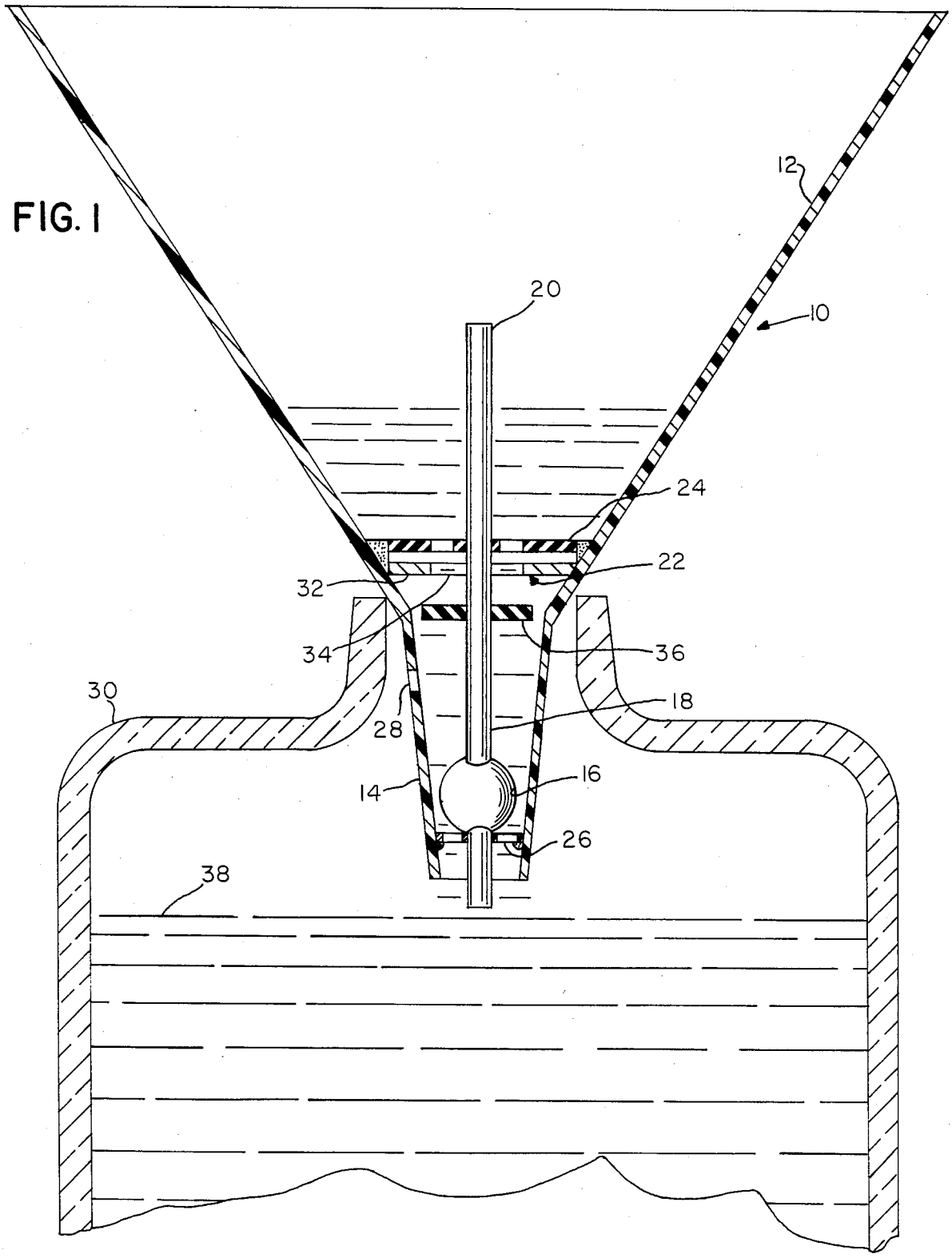
FIG. 1 is a view in axial section through the safety funnel showing a container being filled.

The safety funnel of this invention is generally indicated by the reference numeral 10. It is comprised of a standard funnel consisting of a conical reservoir body 12 and a downwardly depending spout 14 within which is supported a float 16.

The float 16 is supported by a slidable vertical guide rod 18 which has a top portion extending substantially into the funnel body 12 to provide a top portion 20 which serves as a manual operator for closing and opening a valve 22 adjacent the upper portion of the spout and lower portion of the funnel body.

The guide rod is slidably fitted within a top strainer 24 and a bottom strainer 26 which are fixed to the lower portion of the funnel body and the lower end of the spout, respectively. The strainers provide for the passage of fluid while serving the additional functions of providing a guide for the guide rod and protecting the interior parts inside the spout against physical contact and damage. The spout may also be provided with openings 28 for facilitating passage of fluid through the spout into a container 30 to be filled.

The valve 22 is comprised of a ring magnet 32 fixed to the funnel and having an enlarged central opening 34 to receive the smaller diameter guide rod while permitting the passage of fluid therethrough. The magnet acts as a valve seat against which a metallic member 36, e.g. a washer, fixed to the guide rod may be moved into and out of seating engagement against the ring magnet valve seat as shown in the valve open position of FIG. 1 and the valve closed position of FIG. 2 when the container is filled to cause the float 16 guide rod 18 and metallic member 34 to rise. The metallic member 36 has an outer diameter greater than the central opening 34 of the magnet to provide a seating relation in the valve closed position but less than the internal diameter of the spout for passage of fluid around it. It will be understood that the positional relationship of the magnet 32 and metallic member 36 may be reversed as desired. Also the ring magnet and metallic member may be provided with O-ring seals or gaskets for a firm seal as will be well understood in the art.

USE

The safety funnel of this invention is employed as any standard funnel. The valve is opened by manually depressing the top portion 20 of the guide rod to unseat the metallic member 36 away from the magnetic force of the magnet valve seat 32 in the position shown in FIG. 1. Fluid is then poured into the funnel in the usual fashion to fill the container 30 having a closure opening within which the funnel spout may be inserted to the fill level shown in FIG. 2.

When the surface of the fluid level reaches the top portion of the container the buoyancy of the float 16 causes the guide rod 18 and connected metallic member 36 to rise and by engagement of the metallic member against the magnet valve seat 32 cause the closing of the valve 22. Further flow through the spout is shut off preventing overfill and spillage which in the case of gasoline or toxic fuels of one type or another can cause obvious damage. In the valve seating operation the buoyanvy force of the float and the magnetic attraction of the valve member provide a combined force to effect a rapid and positive seating force.

Figure 2:
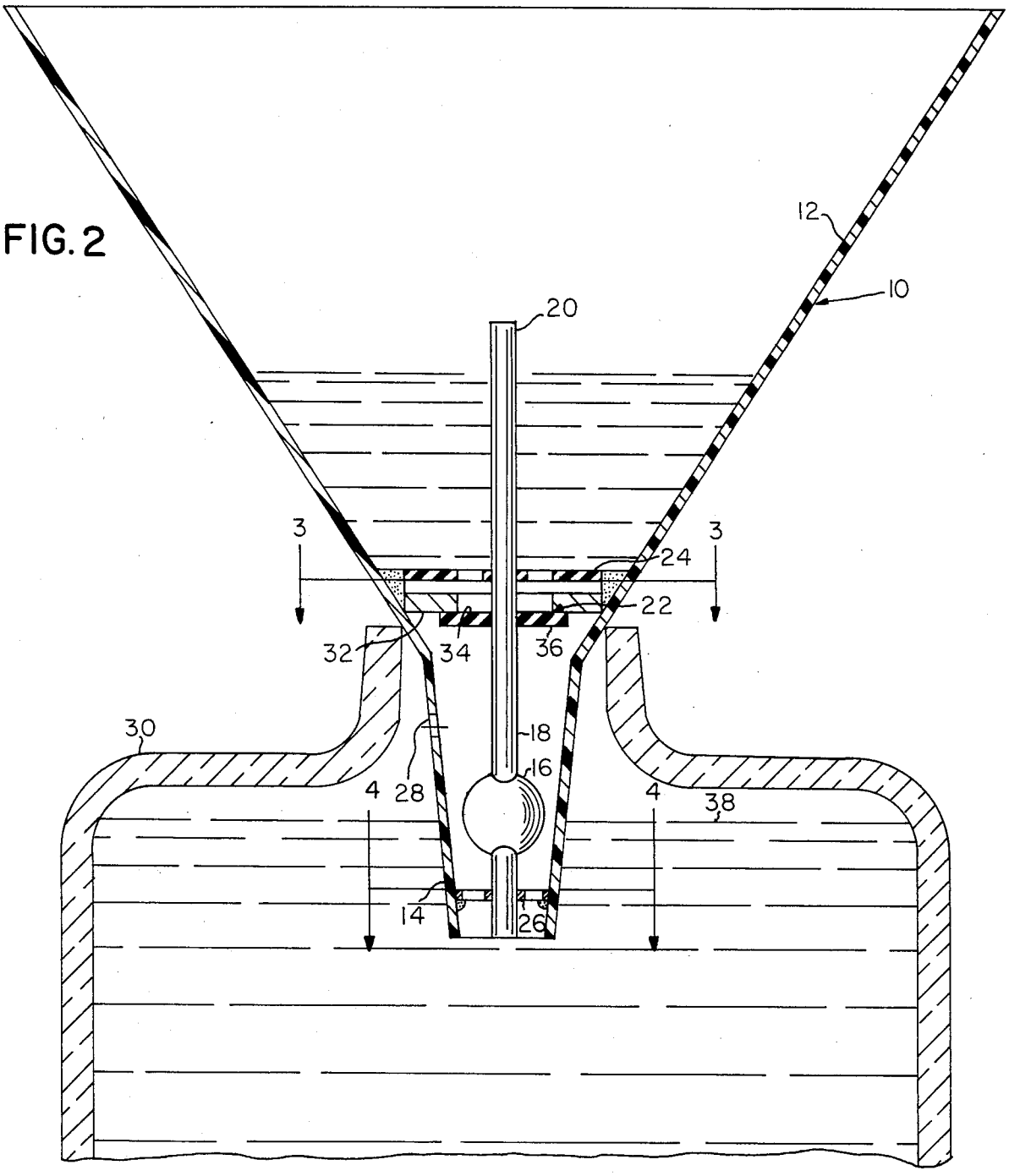
FIG. 2 is a view similar to FIG. 1 showing the valve in the closed position.
Figure 3:
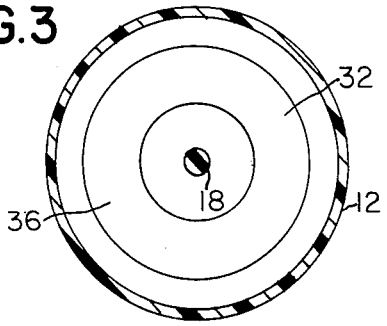
FIG. 3 is a view in section taken on line 3—3 of FIG. 2.
Figure 4:
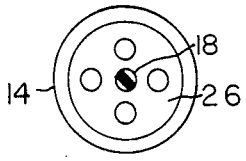
FIG. 4 is a view in section taken on line 4—4 of FIG. 2.

With the valve closed excess fluid in the funnel, as shown at the surface level 38 in FIG. 2 can be readily drained into another container by depressing the operating portion 20 of the guide rod to open the valve 22. The valve 22 is maintained in the closed position for movement of the funnel form one area to another by the magnetic attraction between the magnet valve seat 32 and the metallic member. This ensures proper and positive closing of the valve until it is reset to the open position.

In use the the two strainers 24 and 26 serve efficiently to protect the interior parts while also serving as a bearing or guide for the guide rod 18 and providing a barrier to clogging by foreign particles. The only moveable part outside the fixed top and bottom strainers 24 and 26 is the operating portion 20 of the guide rod 18 which may be used for opening and closing the valve as described above.

Various changes and modifications may be made within this invention as will be apparent to those skilled in the art. Such changes and modifications are within the scope and teaching of this invention as defined in the claims appended

What is claimed is:

1. A safety funnel to prevent fluid overfill of a container, said funnel comprising a reservoir body and a depending elongated spout, a float member supported by an elongated member connected to the funnel and extending in said funnel spout, valve means operable by said float member to open and close the flow of fluid through the spout said float member being responsive to immersion in the fluid level in the container to be filled to operate said valve means to a closed position, a magnetic member to maintain said valve means in a closed position, said magnetic member comprising a magnet fixed to the funnel and a metallic member fixed to the elongated member, said metallic member being movable with the float member upon immersion of the float member at fluid level toward said magnet to close said valve means and maintain it closed upon removal of the funnel, said float member being connected to said elongated member inside said spout and receivable in said spout in protected relation in opened and closed valve means position and a top strainer member and a bottom strainer member fixed adjacent an upper and lower portion of the spout and having a central openings slidably receiving in guided relation said elongated member, said float member being receivable in said spout between said top and bottom strainer members to provide said protected relation.

2. A safety funnel to prevent fluid overfill of a container, said funnel comprising a reservoir body and a depending elongated spout, a float member supported by an elongated member connected to the funnel and extending in said funnel spout, valve means operable by said float member to open and close the flow of fluid through the spout, said float member being responsive to immersion in the fluid level in the container to be filler to operate said valve means to a closed position, and a magnetic member to maintain said valve means in a closed position, said magnetic member comprising a magnet fixed to the funnel and a metallic member fixed to the elongated member, said metallic member being moveable with the float member upon immersion of the float member at fluid level toward said magnet to close said valve means and maintain it closed upon removal of the funnel, said float member being connected to said elongated member inside said spout and said magnet having an opening for fluid flow and said magnet acting as a valve seat for said valve means and said metallic member being moveable into and out of engagement against said magnet to close and open said valve means responsive to the movement of said float member, a top strainer member and a bottom strainer member fixed ajacent an upper and lower portion of the spout and having central openings slidably receiving in guided relation said elongated member and said float member being connected to said elongated member inside said spout between said top and bottom strainer members.

3. The safety funnel of claim 2 in which said elongated member extends into the funnel body and has an upper end portion which may be manually depressed to over said metalic member away from said magnet to open the valve means to an open position.

4. A safety funnel to prevent fluid overfill of a container, said funnel comprising a reservoir body and a depending elongated spout, a float member supported by an elongated member connected to the funnel and extending in said funnel spout, valve means operable by said float member to open and close the flow of fluid through the spout, said float member being responsive to immersion in the fluid level in the container to be filled to operate said valve means to a closed position, a magnetic member to maintain said valve means in a closed position, said magnetic member comprising a magnet fixed to the funnel and a metallic fixed to the elongated member, said metallic member being moveable with the float member upon immersion of the float member at fluid level toward said magnet to close said valve means and maintain it closed upon removal of the funnel, said float member being connected to said elongated member inside said spout and receivable in said spout in protected relation in open and closed valve means position and top and bottom guides adjacent an upper and lower portion of the spout, each of said top and bottom guides having central openings slidably receiving in guided relation said elongated member, said float member being receivable in said spout between said top and bottom guides to provide said protected relation.

5. The safety funnel of claim 4 in which the top guide is a strainer.

* * * * *